United States Patent [19]

Nishikawa et al.

[11] 4,223,287

[45] Sep. 16, 1980

[54] ELECTRICAL FILTER EMPLOYING TRANSVERSE ELECTROMAGNETIC MODE COAXIAL RESONATORS

[75] Inventors: Toshio Nishikawa, Nagaokakyo; Youhei Ishikawa; Sadahiro Tamura, both of Kyoto; Haruo Matsumoto, Nagaokakyo, all of Japan

[73] Assignee: Murata Manufacturing Co., Ltd., Kyoto, Japan

[21] Appl. No.: 876,245

[22] Filed: Feb. 9, 1978

[30] Foreign Application Priority Data

| | | | |
|---|---|---|---|
| Feb. 14, 1977 | [JP] | Japan | 52-15203 |
| Feb. 14, 1977 | [JP] | Japan | 52-16815[U] |
| Feb. 14, 1977 | [JP] | Japan | 52-16816[U] |
| Jul. 5, 1977 | [JP] | Japan | 52-80826 |
| Jan. 5, 1978 | [JP] | Japan | 53-327[U] |
| Jan. 19, 1978 | [JP] | Japan | 53-5470 |
| Jan. 19, 1978 | [JP] | Japan | 53-5471 |
| Jan. 19, 1978 | [JP] | Japan | 53-5472 |
| Jan. 19, 1978 | [JP] | Japan | 53-5473 |

[51] Int. Cl.[3] ..... H01P 1/205; H01P 7/04

[52] U.S. Cl. ..... 333/206; 333/207; 333/223

[58] Field of Search ..... 333/202, 206, 207, 219, 333/222–226, 245

[56] References Cited

U.S. PATENT DOCUMENTS

| | | | |
|---|---|---|---|
| 2,470,805 | 5/1949 | Collard | 333/206 |
| 3,197,720 | 7/1965 | Dehn | 333/206 |
| 4,151,494 | 4/1979 | Nishikawa et al. | 333/206 X |

*Primary Examiner*—Marvin L. Nussbaum

*Attorney, Agent, or Firm*—Birch, Stewart, Kolasch & Birch

[57] ABSTRACT

An electrical filter comprising a cylindrical metal case having an aperture extending in a line, a plurality of ¼ wave length transverse electromagnetic mode coaxial resonators inserted in the aperture of the metal case in an electrical series fashion, each resonator including a dielectric resonator comprising a cylindrical dielectric material, an outer conductor and an inner conductor, the open circuit ends of the adjacent dielectric resonators being capacitively coupled and the short circuit ends of the adjacent dielectric resonators being inductively coupled by means of a coupling electrode having a coupling window. Preferably, a portion of the dielectric material having a lesser influence upon the fundamental mode is made in a lower dielectric constant to improve the spurious response characteristic. In another embodiment of the invention, a rectangular parallelepiped metal case is provided, wherein two or more apertures are formed in parallel rows, and the plurality of dielectric resonators are arranged in parallel rows but in an electrical series fashion.

26 Claims, 35 Drawing Figures

FIG. 27
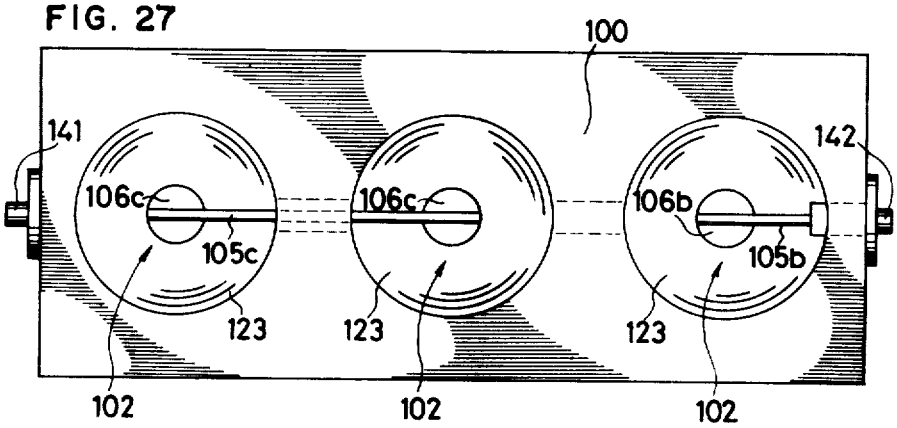
FIG. 28
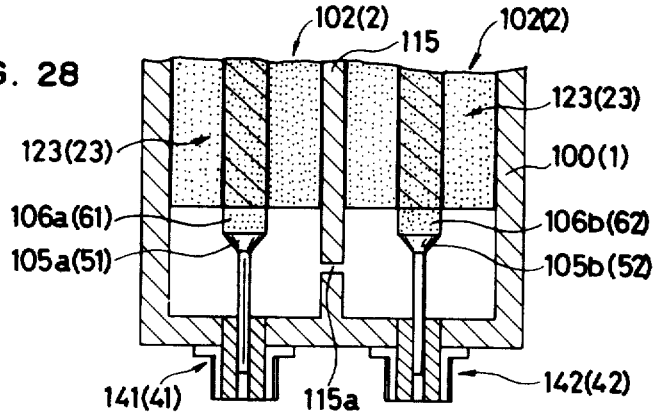
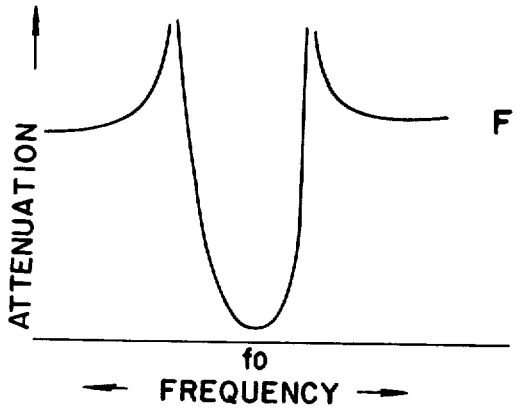
FIG. 29

ELECTRICAL FILTER EMPLOYING TRANSVERSE ELECTROMAGNETIC MODE COAXIAL RESONATORS

BACKGROUND OF THE INVENTION

1. Field of the Invention

The present invention relates to an electrical filter, and more specifically relates to an electrical filter employing a transverse electromagnetic mode coaxial resonator of a ¼ wave length in a microwave.

2. Description of the Prior Art

As an electrical filter for use in VHF and UHF band ranges, filters utilizing an LC resonator, coaxial resonator, or the like have been conventionally utilized. However, the filters of the above described types have disadvantages that, in the former type, sufficient selectivity cannot be attained, while in the latter type the size is likely to be large.

Recently, in the field of communication equipment, compactness and light weight of the system are strongly demanded and attempts have been made to reduce the size and weight of various components. However, the fact that it is difficult to make the filter compact and light in weight has retarded the miniaturization and reduction in weight of the system, and in spite of the extensive use of the system due to its importance. Thus, achievement of compact size and light weight of the filters has been mandatory goal for engineers in this field to attain.

On the other hand, filters of excellent selectivity characteristics are desired, depending on the application thereof. However, an attempt to make narrow the bandpass width for the purpose of improving the selectivity characteristic makes the filters less stable with respect to temperature variation and, at the same time, is liable to increase the insertion loss. On the other hand, an attempt to increase the quality factor Q for the purpose of decreasing the insertion loss makes the filter large size and more responsive to spurious noise, etc.

SUMMARY OF THE INVENTION

Briefly described, the present invention comprises an electrical filter, comprising one or more transverse electromagnetic mode coaxial resonators, each comprising a dielectric resonator including a dielectric member between an internal and an external conductor, said plurality of resonators being arranged such that the open circuit end of each resonator is capacitively coupled and the short circuit end of each resonator is inductively coupled. In a preferred embodiment of the present invention, a portion of the electric member in the resonator may be removed or may be replaced by another dielectric member of a lower dielectric constant, thereby to relatively reduce the effective dielectric constant of that portion, whereby the resonance characteristic is shifted and the spurious characteristic is improved. Preferably, at least one ½ wave length transverse electromagnetic mode coaxial dielectric resonator may be employed in the inventive filter, whereby designing and fabrication of the inventive filter can be facilitated.

Therefore, a principal object of the present invention is to provide an electrical filter which can be made small sized.

Another object of the present invention is to provide an electrical filter of the above described type in which a higher quality factor Q is attained.

A further object of the present invention is to provide an electrical filter of the above described type which is superior in a temperature characteristic.

Still a further object of the present invention is to provide an electrical filter of the above described type which is superior in a spurious response.

Another object of the present invention is to provide an electrical filter of the above described type which can be readily assembled in manufacture and which gives faithful performance as designed.

These objects and other objects, features, aspects and advantages of the present invention will become more apparent from the following detailed description of the present invention when taken in conjunction with the accompanying drawings.

BRIEF DESCRIPTION OF THE DRAWINGS

FIG. 27 shows a plan view of the FIG. 26 embodiment;

FIG. 28 shows a sectional view of another embodiment of an external connection for use in the present invention; and FIG. 29 shows a frequency characteristic of the FIG. 28 embodiment.

DESCRIPTION OF THE PREFERRED EMBODIMENTS

Figure 1:
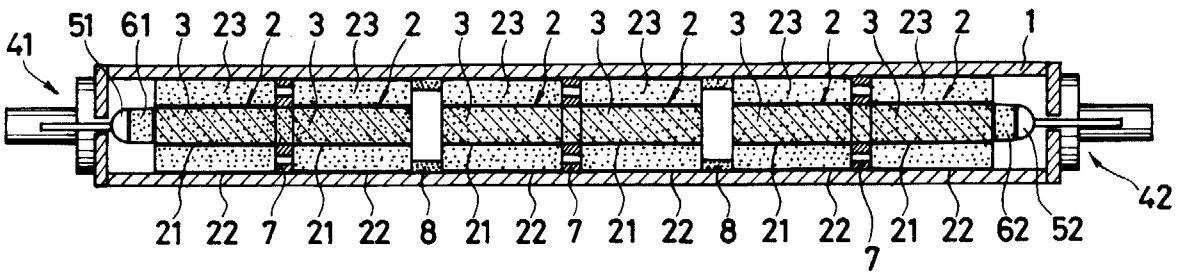
FIG. 1 shows a sectional view of one embodiment of the present invention.
Figure 2:
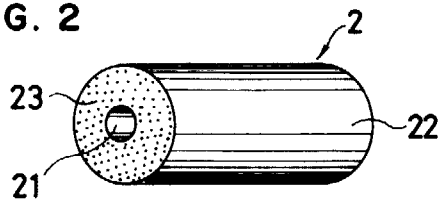
FIG. 2 shows a perspective view of a preferred embodiment of a ¼ wave length transverse electromagnetic mode coaxial resonator for use in the present invention.

Referring to FIG. 1, there is shown a sectional view of one embodiment of the present invention. The embodiment shown comprises a cylindrical casing 1 made of an electrically conductive material such as duralumin or the like, in which a plurality of (six in the embodiment shown) ¼ wave length transverse electromagnetic mode coaxial resonators 2, 2, 2 . . . are housed as arranged in a line in the axial direction of the casing 1. Only one ¼ wave length transverse electromagnetic mode coaxial resonator 2 is shown in FIG. 2 as comprising a cylindrical inner conductor 21, a coaxial cylindrical outer conductor 22 and a dielectric material 23 made of ceramic of titanium oxide group formed between the inner and outer conductors 21 and 22. More specifically, the ¼ wave length transverse electromagnetic mode coaxial resonator 2 may be fabricated by preparing a cylindrical dielectric material 23 having a central bore or aperture, forming a silver paste layer superior in a high frequency conductivity and adhesiveness to a dielectric material on both the inner surfaces of the central bore and the outer surfaces of the dielectric material, and firing the composite, thereby to form the inner and outer conductors 21 and 22. The dielectric material 23 is preferably made of ceramic. The reason is that the respective conductors 21 and 22 are preferably made of silver in order to minimize the loss but the firing temperature of silver is 600° through 900° C. and this requires that the dielectric material 23 be of a material that can withstand the above described firing temperature. If the conductors 21 and 22 are formed otherwise than the above described silver firing, the dielectric material 23 may be of a different material. As described previously, the dielectric material 23 of the respective resonators 2 is formed of the central bore or aperture. The bore is used for insertion of a central rod 3 made of similar ceramic or the like, which serves to mechanically strengthen the dielectric material 23. An input coupling capacitor 61 is coupled to the input of the series arrangement of the resonators 2, 2, 2 . . . housed in the cylindrical casing 1 and an output coupling capacitor 62 is coupled to the output of the above described series arrangement of the resonators. In other words, the embodiment shown is capacitively coupled both at the input and output. These coupling capacitors 61 and 62 may each comprise electrodes formed at both end surfaces of a cylindrical dielectric block, for example. One electrode of the coupling capacitor 61 is connected to the inner conductor 21 of the input side resonator 2, while the other electrode of the coupling capacitor 61 is connected to the input impedance matching terminal 51. Similarly, one electrode of the coupling capacitor 62 is connected to the inner conductor 21 of the output side resonator 2 and the other electrode of the coupling capacitor 62 is connected to the output impedance matching terminal 52. The input impedance matching terminal 51 is connected to the input coaxial connector 41 and the output impedance matching terminal 52 is connected to the output coaxial connector 42.

Figure 3A:
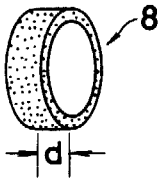
FIGS. 3A and 3B each show a perspective view of a preferred embodiment of a spacer.
Figure 3B:
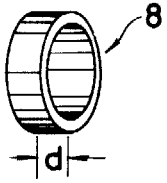

Since the above described transverse electromagnetic mode coaxial resonators 2, 2, 2 . . . are each a ¼ wave length resonator, it follows that one end is a short circuit while the other end is an open circuit. The open circuit ends of these resonators 2, 2, 2 . . . are coupled to each other through a stray capacitance as controlled as a function of a distance therebetween by means of a spacer 8, for example, while the short circuit ends of the resonators 2, 2, 2 . . . are coupled to each other by means of a coupling electrode 7. The spacer 8 may comprise a ring shaped dielectric material having a given thickness d and having a lower dielectric constant such as forsterite and the degree of mutual coupling between the adjacent resonators can be adjusted by varying the distance d therebetween as a function of the thickness of the spacer 8. Alternatively, the spacer may be made of a metal, as shown in FIG. 3B. The ring like shape of the spacer 8 as described in the foregoing should not be construed by way of limitation, however, inasmuch as a spacer of any other geometry may be employed for the purpose of keeping constant the distance between the adjacent resonators. If desired, such spacers may be adhered to the respective resonators in advance and before assemblage.

Figure 4A:
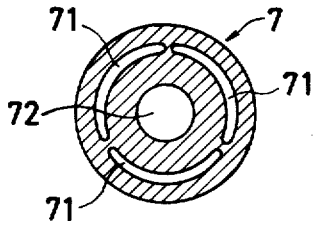
FIGS. 4A, 4B and 4C each show a plan view of an electrode for inductive coupling.
Figure 4B:
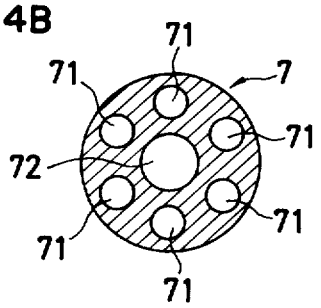
Figure 4C:
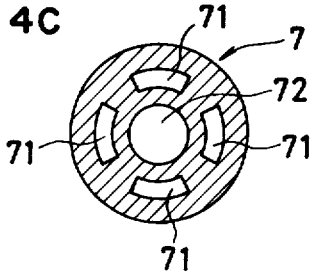
Figure 4D:
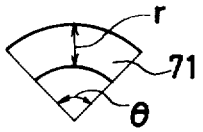
FIG. 4D shows an enlarged view of a portion of a coupling window in the FIG. 4C embodiment.

Various examples of the above described electrode 7 are shown in FIGS. 4A, 4B and 4C, wherein a plan view of such an electrode example for inductive coupling is shown in each figure. In general, the electrode 7 is structured to have inductive coupling windows 71 and a central bore or aperture 72. The inductive coupling windows 71 are used to adjust the coupling state between the adjacent resonators as a function of the size of the windows, while the central aperture 72 is used for insertion of the above described central rod 3 and is not necessarily required. The coaxial transverse electromagnetic mode is a point symmetrical mode and deterioration of such symmetry could give rise to the degradation of a spurious characteristic by a higher harmonic mode. For this reason, the inductive coupling windows 71 of the above described electrode 7 should be preferably made in a pattern superior in symmetry as much as possible. Referring to FIG. 4A, for example, the electrode 7 is shown as three inductive coupling windows 71 formed along the peripheral direction such that these three coupling windows 71 each have the three rotational axis. Referring to FIG. 4B, the electrode 7 is shown as six coupling windows 71 each having the six rotational axis. Referring further to FIG. 4C, the electrode 7 shown has four coupling windows 71, each of which is fan shaped, as shown in more detail in FIG. 4D in an enlarged manner. The degree of opening by the coupling windows 71 in the FIGS. 4C and 4D embodiment is determined by the fan angle $\theta$ and the radial distance r. Accordingly, in the FIGS. 4C and 4D embodiment can be expressed by polar co-ordinates with the central axis as an axis. This fact facilitates designing of the degree of coupling. The electrode 7 may be formed by firing of a silver paste layer, photoetching process, or a thin silver plate or white gold plate prepared in advance in a desired configuration. The configuration or pattern of the inductive coupling window 71 to be formed in the electrode 7 may be of any other shape than shown in FIGS. 4A, 4B and 4C.

Assembly of the filter described above can be effected in the manner described in the following by way of an example. A plurality of ¼ wave length transverse electromagnetic mode coaxial resonators 2, 2, 2 . . . are inserted in the casing 1 in a cascade fashion with the electrode 7 or the spacer 8 interposed therebetween for mutual coupling thereof. The outer conductors 22 of the respective resonators 2 are secured to the inner wall of the casing 1 by means of a conductive bonding agent injected through an aperture, not shown, formed in the casing 1, for the purpose of mechanical fixing and electrical connection. Preferably, the above described injection aperture may be formed in the vicinity of both end portions of the respective resonators 2, so that the loss may be minimized. Alternatively, the respective resonators 2 may be fixed to the inner wall of the casing 1 by means of a screw, preferably with the respective resonators 2 housed in the casing such that the resonators 2 may be in close contact with the inner wall of the casing 1. For the purpose of mechanical reinforcement, the central rods 3 may be inserted into the respective resonators 2, as necessary. The assembly of the plurality of resonators 2 thus arranged is coupled at one end surface thereof to the input coupling capacitor 61, input coupling terminal 51 and the input coaxial connector 41 and at the other end surface to the output coupling capacitor 62, the output coupling terminal 52 and the output coaxial connector 42. Both end surfaces of the casing 1 may be covered with a screw lid or provided with a bolt or the like. Alternatively, the casing 1 may be structured such that the respective coaxial connectors 41 and 42 may constitute both end surfaces of the casing 1.

Figure 5:
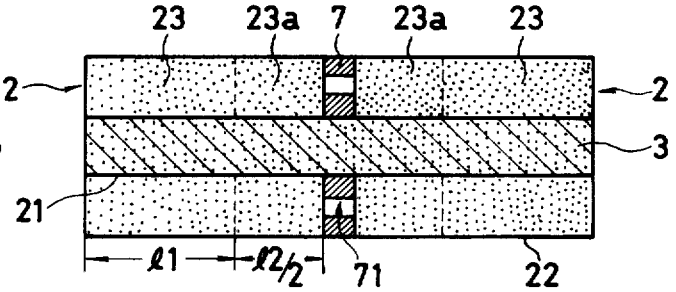
FIG. 5 shows a sectional view of another preferred embodiment of a combination of two ¼ wave length transverse electromagnetic mode coaxial resonators for use in the present invention.

Now a preferred embodiment of the present invention for improving the spurious response will be described in detail with reference to FIGS. 5 through 8. Referring first to FIG. 5, which shows only two resonators 2 for simplicity, the embodiment shown is structured such that the dielectric material 23*a* at the short circuit side as coupled is made of a material of the dielectric constant smaller as compared with that of the dielectric material 23 of the remaining portion. THus, the forsterite or the like may be utilized as the dielectric material 23*a*.

According to the above described structure, the elec- c field intensity of the fundamental wave becomes zero or substantially zero at the short circuit surface of the ¼ wave length transverse electromagnetic mode coaxial resonator 2. Therefore, even if the dielectric constant of the dielectric material 23*a* is small, the influence thereof upon the resonance frequency is accordingly small. However, the electric field intensity of the third harmonic becomes abruptly larger at the position away from the short circuit side of the resonator. Hence, since the effective dielectric constant is considerably small, the result is that an influence upon the resonance frequency becomes considerably large. In other words, resonance of the third harmonic which is liable to degrade the spurious characteristic, will occur at a higher frequency region. The resonance wave length of the resonator thus structured may by expressed as follows.

$$\lambda_0 = 2\tan\theta 1 + \sqrt{\frac{\epsilon 2}{\epsilon 1}}\ \tan\theta 2\left(1 - \frac{\epsilon 2}{\epsilon 1}\tan^2\theta 1\right) \text{ and when}$$

$$\theta 1 = \beta 1 l 1 \text{ and, } \theta 2 = \beta 2 l 2 = \frac{\beta 2}{\beta 1}\cdot\frac{l 2}{l 1}\cdot\theta 1$$

$$= \sqrt{\frac{\epsilon 2}{\epsilon 1}}\cdot\frac{l 2}{l 1}\cdot\theta 1,$$

then the expression for $\lambda^0$ simplifies to;

$$\lambda_0 = \frac{2\pi}{\beta 1}\sqrt{\epsilon 1}$$

where $\theta 1$ is the electrical length of the dielectric material 23, $\theta 2$ is the electric length of the dielectric material 23*a*, $\beta 1$ is the wave length constant of the dielectric material 23, $\beta 2$ is the wave length constant of the dielectric material 23*a*, l1 is the geometrical length of the dielectric material 23, l2/2 is the geometrical length of the dielectric material 23*a*, $\epsilon 1$ is the dielectric constant of the dielectric material 23, and $\epsilon 2$ is the dielectric constant of the dielectric material 23*a*.

Figure 6:
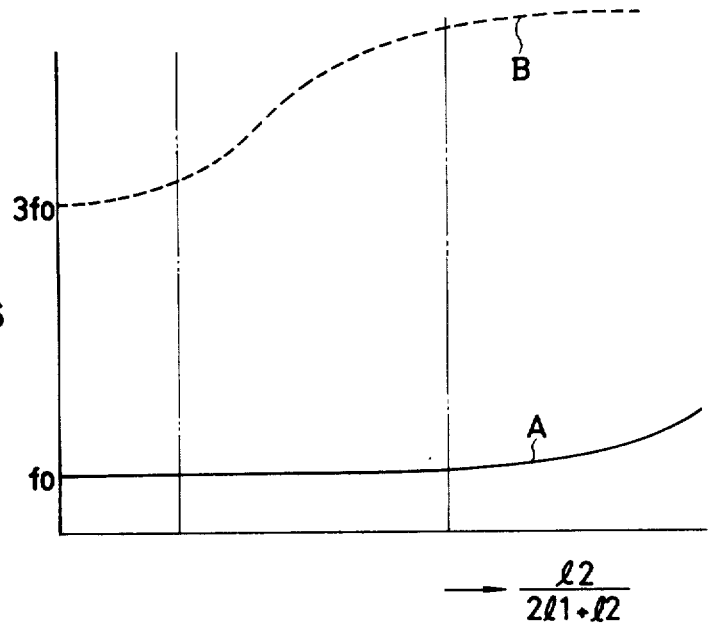
FIG. 6 shows a graph of a frequency characteristic of the FIG. 5 embodiment.

Now referring to FIG. 6, description will be made of the effect of the FIG. 5 embodiment, i.e. an improvement in the spurious characteristic by the third harmonic attained by the FIG. 5 embodiment. FIG. 6 shows a graph of the characteristic of the embodiment, wherein the abscissa indicates l2/2l1+l2 in the above described equations and the ordinate indicates the frequency and the curve A shows the characteristic of the fundamental wave f0 while the curve B shows the characteristic of the third harmonic 3f0. As apparent from the figure, as the length l2/2 of the dielectric material 23*a* becomes larger, the resonance frequency of the third harmonic becomes abruptly large, while the fundamental resonance frequency remains substantially unchanged. Accordingly, the length l2/2 of the dielectric material 23*a* would be selected in consideration with the above.

Incidentally described, the experimentation showed that the quality factor Q of the resonator 2 did not show any change, as compared with a case where the dielectric constant is constant throughout the length.

Although the transverse electromagnetic mode coaxial resonator as described in the foregoing brings about a great advantage in that the spurious characteristic is improved, such a partial change of the dielectric constant requires a partial change of the material, which inevitably entails more complicated fabrication of such resonator. More specifically, if the dielectric material is partially different, the firing process needs to be carried out individually for different portions under the individual different conditions, which requires different electric furnaces, with the result that a problem to be solved is encountered in that the manufacturing process is inconvenient.

Figure 7:
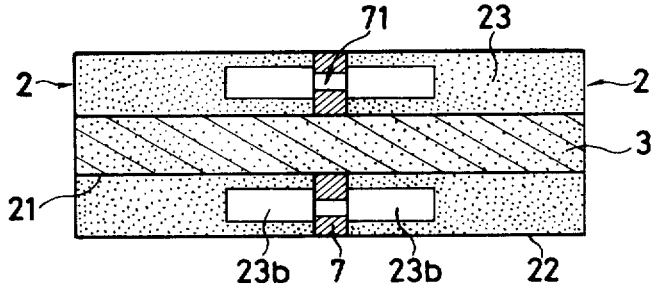
FIGS. 7 and 8 each show a sectional view of a further preferred embodiment of a combination of two ¼ wave length transverse electromagnetic mode coaxial resonators for use in the present invention.

The above described problems are eliminated while the spurious characteristic is improved, in accordance with the embodiment of the transverse electromagnetic mode coaxial resonator to be described subsequently. Referring to FIG. 7, there is shown a composite of only two resonators 2, as similar to FIG. 5. The resonator 2 shown is formed of a hollow portion 23*b* at the short circuit side of the dielectric material 23. It has been observed that the hollow portion 23*b* may be formed in lieu of the low dielectric constant material 23*a* to attain the same effect. According to the embodiment shown, only one kind of the dielectric material can be utilized, which simplifies the firing process and makes inexpensive the manufacturing cost. Such hollow portion 23b can be formed in the same manner as described subsequently in conjunction with a ½ wave length resonator shown in FIG. 14 with reference to FIGS. 15A and 15B.

Figure 8:
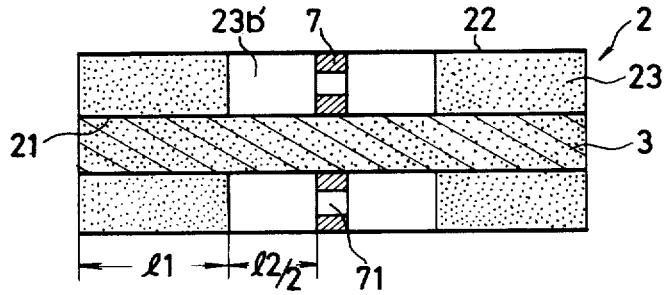

FIG. 8 shows a sectional view of a further preferred embodiment of a ¼ wave length transverse electromagnetic mode coaxial resonator, wherein a cylindrical metal plate is covered onto the outer surface of a cylindrical dielectric material 23, whereby an outer conductor 22 is formed. A central rod 3 made of ceramic may be inserted into the central aperature of the dielectric material 22 for the purpose of mechanical reinforcement. The central rod 3 may be as long as the outer conductor 22 and is coated on the outer surface with a silver paste layer, as fired, which is superior in the high frequency characteristic and is adhesively secured to the dielectric material, whereby an inner conductor 21 is formed. Alternatively, the inner conductor 21 may be a cylindrical metallic plate, as done for the outer conductor 22. In employing such metallic plate as the inner and outer conductors 21 and 22, such metallic layers may be formed by firing silver in advance in the inner and outer wall surfaces of the dielectric material 23, as described previously.

If and when only ¼ wave length transverse electromagnetic coaxial resonators are employed as a resonator for constituting the inventive filter as described previously, a difficult problem is encountered in designing a filter having an odd number of stages by using an odd number of such resonators. More specifically, since the circuit configuration from the central stage resonator to the input side resonator and to the output side resonator is not symmetrical, some inconveniences are caused in designing and fabrication.

Figure 9:
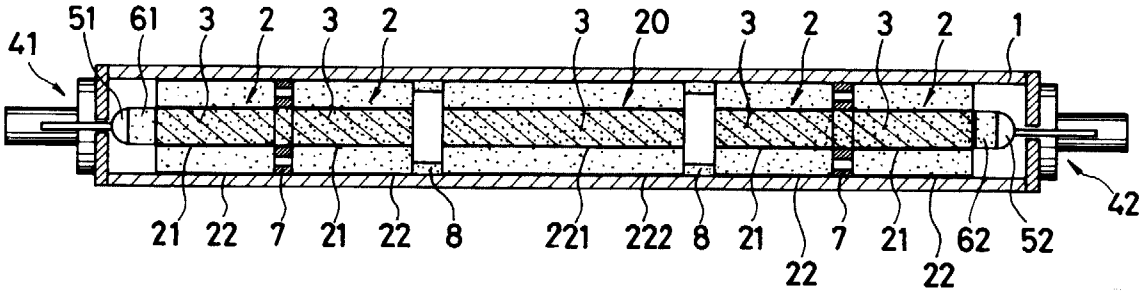
FIG. 9 shows a sectional view of an electrical filter of another embodiment of the present invention.
Figure 10:
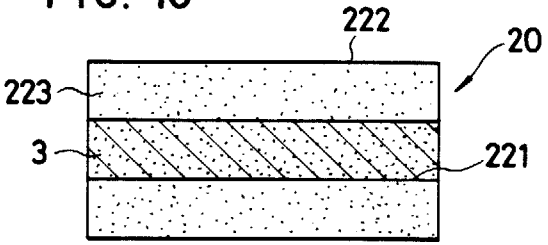
FIG. 10 shows a sectional view of a preferred embodiment of a ½ wave length transverse electromagnetic mode coaxial resonator for use in the present invention.

FIG. 9 shows a sectional view of another embodiment of the present invention, wherein a filter having an odd number of stages which is easy to design and fabricate is provided. Referring to FIG. 9, since the major portion of the FIG. 9 embodiment is substantially the same as that of the FIG. 1 embodiment, only a different portion in the FIG. 9 embodiment will be described in the following paragraph and any further detailed description of the same portion will be omitted. In comparison with the FIG. 1 embodiment, the FIG. 9 embodiment comprises an odd number of (five, in the embodiment shown) resonators to constitute a filter, wherein the central stage resonator comprises a ½ wave length transverse electromagnetic mode coaxial resonator 20 while the remaining four resonators each comprise a ¼ wave length transverse electromagnetic mode coaxial resonators 2. As shown in FIG. 10, the ½ wave length transverse electromagnetic mode coaxial resonator 20 is of substantially the same structure as that of the above described ¼ wave length transverse electromagnetic mode coaxial resonator 2, except that the wave length has been changed from a ¼ wave length to a ½ wave length. Therefore, it is not believed necessary to describe in more detail the structure of the ½ wave length transverse electromagnetic mode coaxial resonator 20. Since both ends of the ½ wave length resonator 20 are open circuit, the ½ wave length resonator 20 is coupled at both ends to the adjacent ¼ wave length resonators 2 through the spacers 8 with a stray capacitance as controlled by the spacers 8. Incidentally described, the coupling of the ¼ wave length resonators 2 at the initial and final stages to the external circuit must be an inductive coupling when the number n-½ is an odd number and must be a capacitive coupling when the number n-½ is an even number, where n is the number of stages.

Such combination as described above of the ½ wave length transverse electromagnetic mode coaxial resonator 20 and the ¼ wave length transverse electromagnetic mode coaxial resonators 2 brings about symmetry of the filter leftward and rightward with respect to the central stage resonator, which facilitates the designing and fabrication of the filter. Nevertheless, the fact that the ½ wave length transverse electromagnetic mode coaxial resonator 20 has a very high quality factor Q particularly degrades the spurious response of the second and fourth harmonics. An improved ½ wave length transverse electromagnetic mode coaxial resonator 20 having an improved spurious response will now be described in the following with reference to FIGS. 11 through 14 and FIGS. 15A through 15D.

Figure 11:
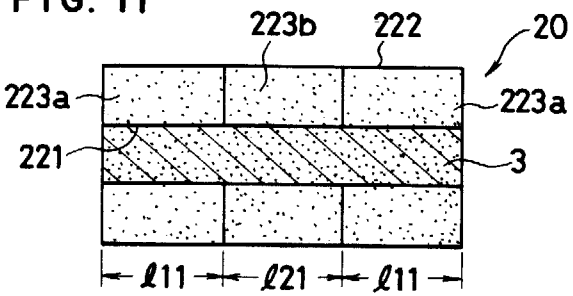
FIG. 11 shows a sectional view of another preferred embodiment of a ½ wave length transverse electromagnetic coaxial resonator for use in the present invention.

Referring to FIG. 11, a resonator 20 is shown which comprises an inner conductor 221 and an outer conductor 222 and three dielectric materials 223a, 223b and 223a interposed between the inner conductor 221 and the outer conductor 222, wherein a central rod 3 is inserted as necessary through the central portion of the dielectric material inside the inner conductor 221 for the purpose of mechanical reinforcement of the dielectric material. The above described dielectric material 223a may be made of a dielectric having a relatively high dielectric constant such as ceramic of the titanium oxide group and the dielectric material 223b may be made of the dielectric having a relatively low dielectric constant such as forsterite, for example. The central rod 3 may also be made of a ceramic material. More specifically, the resonator 20 may be formed by adhering the respective dielectric materials 223a, 223b and 223a each having the central bore or aperture and forming a silver paste layer by firing on the inner wall of the central bore and the outer wall of the dielectric materials, thereby to form the inner conductor 221 and the outer conductor 222. These dielectric materials may be different ones, however, insofar as the relation of the dielectric constants of the respective dielectric materials 223a, 223b and 223a is similarly selected.

Since ½ wave length transverse electromagnetic mode coaxial resonator 20 is thus structured as a both-end open type, the fundamental electric field becomes zero or substantially zero at the center of or in the vicinity of the center of the resonator, i.e. inside the dielectric material 223b and little influence is caused to the fundamental wave in spite of a smaller dielectric constant of the dielectric material 223b. However, with such resonator 20, the electric field of the second harmonic becomes the maximum value or approaches the maximum value at the center of or in the vicinity of the center of the resonator 20. Therefore, selection of a decreased dielectric constant of the material there considerably decreases the effective dielectric constant thereof, which increases an influence upon the second harmonic resonance frequency. In other words, the resonance of the second harmonic becomes a problem as a spurious harmonic at the higher frequency region. The resonance wave length of such structured resonator may be expressed as follows.

$$\lambda_0 = 2\tan\theta 11 + \sqrt{\frac{\epsilon 21}{\epsilon 11}}\tan\theta 21\left(1 - \frac{\epsilon 21}{\epsilon 11}\tan^2\theta 11\right) \text{ and}$$

$$\theta 11 = \beta\, 11 l 11, \text{ and } \theta 21 = \beta\, 21 l 21 = \frac{\beta 21}{\beta 11}\cdot\frac{l 21}{l 11}\cdot\theta 11$$

$$= \sqrt{\frac{\epsilon 21}{\epsilon 11}}\cdot\frac{l 21}{l 11}\cdot\theta 11,$$

then the expression for $\lambda_0$ simplifies to;

$$\lambda_0 = \frac{2\pi}{\beta\, 11}\sqrt{\epsilon\, 11}$$

where $\theta 11$ is the electrical length of the dielectric material 223a, $\theta 21$ is the electrical length of the dielectric material 223b, $\beta 11$ is the wave length constant of the dielectric material 223a, $\beta 21$ is the wave length constant of the dielectric material 223b, l11 is the geometrical length of the dielectric material 223a, l21 is the geometrical length of the dielectric material 223b, $\epsilon 11$ is the dielectric constant of the dielectric material 223a, and $\beta 21$ is the dielectric constant of the dielectric material 223b.

Figure 12:
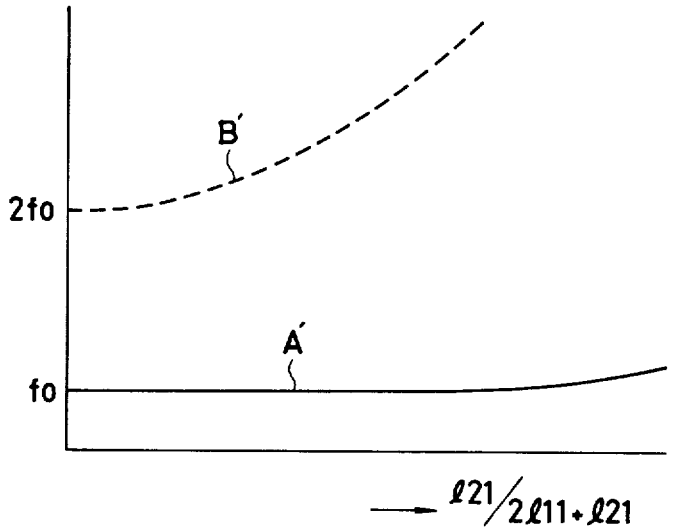
FIG. 12 shows a graph of a frequency characteristic of one embodiment of the present invention.

Referring now to FIG. 12, the effect of the FIG. 11 embodiment, i.e. an improved spurious response of the second harmonic will be described. Referring to FIG. 12, the abscissa shows l21/2l11+l21, while the ordinate shows the frequency in accordance with the above described equation. As seen from the curve B of FIG. 12, as the length of the central portion becomes larger, the frequency of the second harmonic abruptly increases, although the fundamental resonance frequency, as illustrated in curve A, remains substantially unchanged. As a result of experimentation, it has been observed that the quality factor Q of the resonator thus obtained remains totally unchanged as compared with a case where the dielectric constant of the dielectric material is constant throughout the full length of the resonator.

As apparent from the foregoing description, the transverse electromagnetic mode coaxial resonator thus described brings about a conspicuous advantage in that the spurious characteristic is improved but nevertheless leaves a problem to be eliminated in that, as in case of the previously described ¼ wave length resonator change of the dielectric constant from one portion to another portion makes inconvenient the manufacturing process thereof. Therefore, a transverse electromagnetic mode coaxial resonator of an improved spurious characteristic wherein the above described problem has been eliminated will be described in the following.

Figure 13:
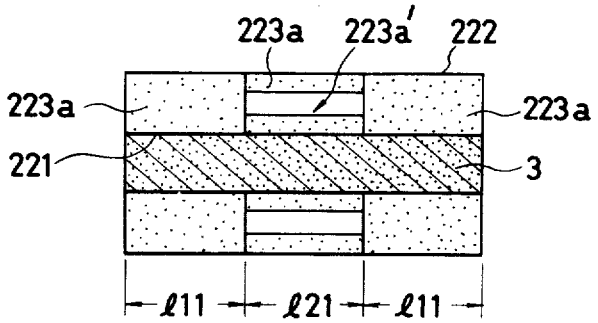
FIGS. 13 and 14 each show a sectional view of a further preferred embodiment of a ½ wave length transverse electromagnetic mode coaxial resonator.

FIG. 13 shows a sectional view of a further preferred embodiment of a ½ wave length transverse electromagnetic mode coaxial resonator 20 of a both-end open type. Since the FIG. 13 embodiment is similar to the FIG. 11 embodiment, except for the following modification, only the modified portion will be described in the following. The dielectric material of the central section as well as both end sections is made of the same dielectric material such as ceramic of a titanium oxide group and therefore these three sections have been denoted as the dielectric material 223a. The dielectric material 222a of the central section is formed of one or more hollow or cavity portion 223a' extending in the axial direction. As a result, the effective dielectric constant of the central section dielectric material 223a is decreased. Therefore, the second harmonic resonance characteristic of the FIG. 13 embodiment is shifted largely toward a higher frequency region as observed in the FIG. 11 embodiment. Therefore, the spurious characteristic is similarly improved in the FIG. 13 embodiment, although the dielectric material 223a of the three sections are made of the same dielectric material. The fact that the dielectric material of these three sections may be of the same dielectric material enables simultaneous firing in the manufacturing process. As a result, the firing step of the FIG. 13 embodiment can be achieved with a single electric furnace and with a single firing step, with the result that the manufacturing cost is considerably reduced.

Figure 14:
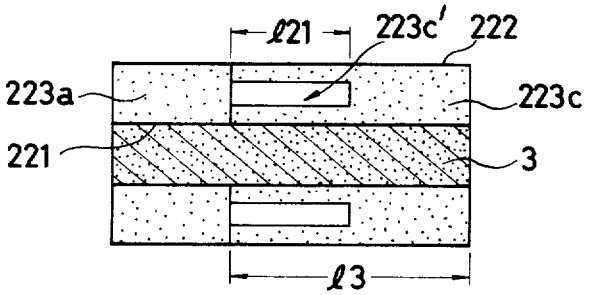

FIG. 14 shows a sectional view of still a further preferred embodiment of a ½ wave length transverse electromagnetic mode coaxial resonator of a both-end open type. Again the FIG. 14 embodiment is similar to the FIG. 13 embodiment, except for the following modified portion. More specifically, the dielectric material of the resonator 20 shown comprises two dielectric material portions 223a and 223c. These two dielectric material portions 223a and 223c are made of the same kind of dielectric material. One dielectric material portion 223c is formed of a cavity 223c at the position corresponding to the central portion of the resonator. The length l3 of the dielectric material portion 223c corresponds to the length l11+l21 in the embodiment shown in FIGS. 11 and 12 and the length l21 of the cavity 223c' corresponds to that of the embodiment in FIGS. 11 and 12. Since according to the embodiment shown only two dielectric material blocks are utilized, the step of joining the dielectric material blocks can be reduced as compared with the case of the FIG. 13 embodiment. As a result, the manufacturing cost can be further reduced as compared with the FIG. 13 embodiment.

Figure 15A:
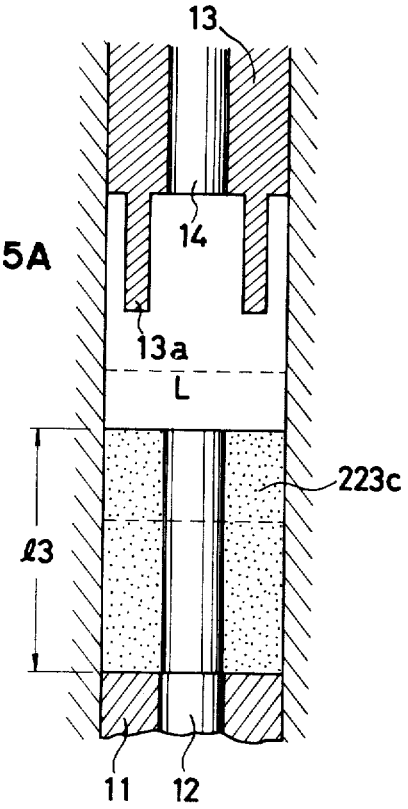
FIGS. 15A and 15B each show a sectional view of the FIG. 14 embodiment (or the FIG. 7 embodiment) at various stages of the manufacturing process thereof.
Figure 15B:
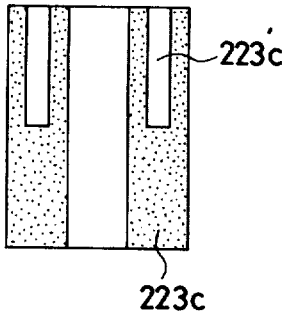

FIGS. 15A and 15B each show a sectional view of the dielectric material 223c of the FIG. 14 embodiment at various stages of the manufacturing process thereof. Referring to FIG. 15A, a cylinder 10 having an internal diameter corresponding to the external diameter of the dielectric material 223c is provided. A rod piston 12 is inserted into the lower portion of the cylinder 10 through an annular piston 11 surrounding the rod piston 12 such that the end surface of the annular piston 11 is kept horizontal. A powder of ceramic of a titanium oxide group for example is filled up to the level L in the space defined by the cylinder 10, and the pistons 11 and 12. Then, from the above described cylinder 10, a rod piston 14 and an annular piston 13 surrounding the rod piston 14 having an annular protuberance 13a for forming the cavity position 223' are brought downward such that the lower end surfaces of the rod piston 14 and the annular piston 13 depresses the ceramic powder filled up to the level L to the position of the length l3. Then, first the cavity 223' is formed and the rod pistons 14 and 12 are then brought downward simultaneously. As a result, a central bore is formed in the dielectric material thus solidified. As a result, the dielectric material block 223c is provided as shown in FIG. 15B. The dielectric material block thus obtained is then inserted in an electric furnace and is fired. The dielectric material block 223c having the cavity 223c' is thus formed.

According to the manufacturing process described in the foregoing, the cavity 223c' can be formed with extreme ease without the necessity of any particular process, with the result that a considerable advantage is brought about from the standpoint of the manufacturing cost. It is pointed out that the process of forming such a cavity in the dielectric material block as described in the foregoing would be advantageously utilized even in the case of the FIG. 7 embodiment of a ¼ wave length transverse electromagnetic mode coaxial resonator 2. Such a cavity would be formed in any other suitable manner, without being limited by the above described process, however.

The length of the transverse electromagnetic mode coaxial resonator is determined by the wave length λ of the electromagnetic wave to be treated by the resonator. Conversely described, the frequency to be treated by the resonator is determined to be a predetermined value by the length of the resonator. Therefore, the following two approaches have been conventionally adopted in order to fine adjust the frequency of such a dielectric resonator: (1) an additional variable capacitor is provided externally of the resonator, or (2) the dielectric material is cut to the optimum length. More specifically, the phase angle $\theta$ of a dielectric resonator is a function of an inter-conductor capacitor C as seen from the equation $\tan\theta = -C\omega ZO$, where C is an inter-conductor capacitance and ZO is a characteristic impedance. Accordingly, a variable capacitor connected to the resonator so as to adjust the inter-conductor capacitance enables variation and thus fine adjustment of the frequency or the wave length depending on the phase angle $\theta$. However, since a variable capacitor generally comprises a metal electrode as a rotor or a stator, the above described approach (1) is disadvantageous in that not only the quality factor Q of the dielectric resonator is lower but also an additional variable capacitor is required on that end. On the other hand, as seen from the relation $\lambda o C L_R \sqrt{\epsilon}$ where $L_R$ is the total length of the resonator and $\epsilon$ is a dielectric constant of the dielectric material, the resonance frequency of the resonator is dependent on the length $L_R$. Therefore, the above described approach (2) is to cut the side end of the dielectric material to shorten mechanically the length $L_R$ of the resonator. However, the above described approach (2) is again disadvantageous in that such cutting work is difficult and is not simple.

According to another aspect of the present invention, still a further preferred embodiment of the inventive transverse electromagnetic mode coaxial resonator is provided wherein frequency adjustment can be simply achieved without an adverse affect on the other characteristics of the resonator.

Figure 16A:
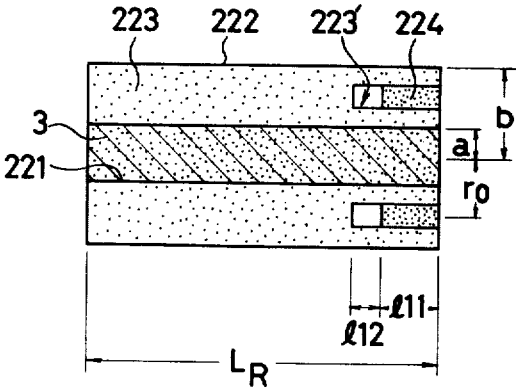
FIGS. 16A and 16B shows a sectional view and a right side view, respectively, of a further preferred embodiment of a ½ wave length transverse electromagnetic mode coaxial resonator for use in the present invention.
Figure 16B:
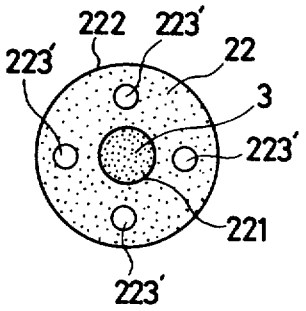

FIGS. 16A and 16B shows a sectional view and a right side view, respectively, of such a further preferred embodiment of a ½ wave length transverse electromagnetic mode coaxial resonator 20 for use in the present invention. Referring to FIGS. 16A and 16B, the dielectric material 223 shown includes four bores 223' opening at the right end surface and extending in the axial direction to a predetermined depth. An adusting rod 224 made of another dielectric material having a different or identical dielectric constant from that of the dielectric material 223 of the resonator main body is inserted into the above described bores 223'. According to the vibration theory of the cavity, the variation rate $\delta\omega/\omega$ of the frequency is obtained by the following equation.

$$-\frac{\delta\omega}{\omega_0} = \frac{(\epsilon_x - \epsilon_r)\, S\,(l11 + \frac{L_R}{2\pi}\sin\frac{2\pi}{L_R}\, l11)}{(\epsilon_r + \epsilon_x)\cdot 2\pi L_R r_0^2 \log\frac{b}{a}}$$

-continued $$+\frac{(\epsilon_0 - \epsilon_r)S(l12 + \frac{L_R}{\pi}\cdot\sin\frac{\pi l12}{L_R}\cdot\cos\pi(2l11 + l12)}{(\epsilon_r + \epsilon_0)\cdot 2\pi L r_0^2 \log\frac{b}{a}}$$

where ωO is the central frequency, δω is the deviation of the frequency, εr is the dielectric constant of the dielectric material 223, εx is the dielectric constant of the adjusting rod 224, $L_R$ is the total length of the resonator, $r_O$ is the distance from the center of the central rod 3 to the center of the adjusting 224, a is the distance from the center of the central rod 3 to the outer periphery of the dielectric material 223, b is the distance from the center of the central rod 3 to the outer most periphery of the adjusting rod 224, S is the sectional area of the adjusting rod 224, l11 is the length of the portion of the adjusting rod 224 which has been inserted to the bore 224', l12 is the length of the remaining cavity of the bore 13, and εO is the dielectric constant of the air in the l12 portion.

As seen from the foregoing equation, the deviation δω of the frequency is a function of the inserted length l11 of the adjusting rod 224, the dielectric constant εx thereof and the sectional area S. Therefore, it would be appreciated that the frequency can be varied by varying the geometry or the material of the adjusting rod 224, by adjusting the inserted length of the adjusting rod 224.

Figure 17:
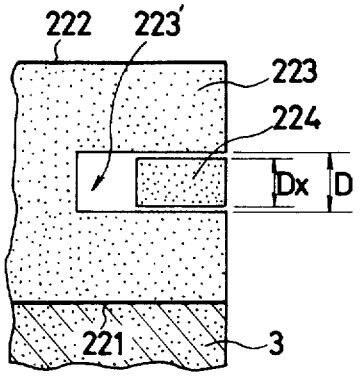
FIG. 17 shows an enlarged view of the FIG. 16A embodiment.
Figure 18:
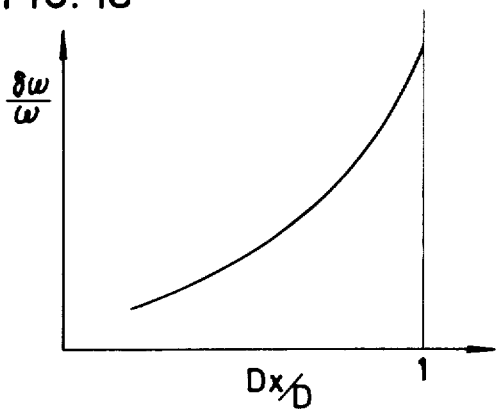
FIG. 18 shows a graph of a frequency characteristic of the embodiment shown in FIGS. 16A, 16B and 17.

Referring to FIG. 17, which shows an enlarged view of the adjusting rod 223' of the FIG. 16A embodiment, although the diameter $D_x$ of the adjusting rod 224 is smaller than the diameter D of the bore 223', the variation rate of the frequency, δω/ωO, is varied, as the diameter ratio $D_x/D$ of these diameters varies, as best seen in FIG. 18, which shows a graph of a frequency characteristics of the embodiment shown in FIGS. 16A, 16B and 17. More specifically, the larger the above described ratio $D_x/D$, the larger the variation rate of the frequency. After once the frequency of the resonator is fine adjusted to a desired value by varying the inserted length l11 of the adjusting rod 224 to the bore 223', the adjusting rod 224 may be fixed by means of a bonding agent, for example. If there is little fear of influence by vibration and the like, the adjusting rod 224 may simply be inserted to be fixed or alternatively may be threaded. The sectional area of the adjusting rod 224 must be smaller than the sectional area of the dielectric material 223.

According to the embodiment shown, the following unique advantages are brought about. Firstly, since the adjusting rod 224 is made of a dielectric material, there is no Joule energy loss by virtue of concentration of the energy. Accordingly, the frequency can be fine adjusted without lowering the quality factor Q of the resonator. Secondly, since the frequency of the resonator is adjusted by a dielectric adjusting rod 224, the effective dielectric constant remains constant throughout the adjustment and accordingly diversified errors of the dielectric constant $\epsilon_r$ of the dielectric material 223 are absorbed and the coupling coefficient k is stabilized. Thirdly, since the dielectric constant $\epsilon_r$ of the adjusting rod 224 can be varied to various values, accurate fine adjustment can be achieved by combining such various values of the dielectric constants, i.e. by inserting selectively the adjusting rods 224 of different dielectric constant $\epsilon_x$ in a plurality of bores 223' of a single resonator 20. Fourthly, since the frequency can be adjusted by the inserted length l11 of the adjusting rod 224, the adjustment can be continually effected, thereby to achieve stabilized adjustment of the frequency.

Figure 19:
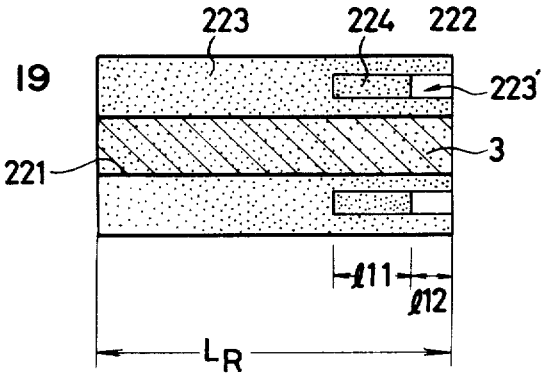
FIG. 19 shows a sectional view of a further embodiment of a ½ wave length transverse electromagnetic mode coaxial resonator for use in the present invention.

The embodiments now in discussion may be further modified as shown in FIG. 19. The FIG. 19 embodiment is similar to the FIG. 16 embodiment except for the following modifications. Therefore, the FIG. 19 embodiment will be described in the following centering on such modified portions. More specifically, one feature to be noted is that a dielectric adjusting rod 224 is inserted to the innermost position of the bore 223'. Thus, it is observed that substantially the same effect can be attained as discussed in conjunction with the FIG. 16 embodiment.

In the FIG. 16A embodiment the adjusting rod 224 was positioned at the outermost position of the bore 223', whereas in the FIG. 19 embodiment the adjusting rod 224 was positioned at the innermost position of the bore 223'. However, alternatively the adjusting rod may be positioned at the intermediate position of the FIGS. 16A and 19 embodiments. In addition, any polygonal sectional shape of the adjusting rod and the bore may be employed as well as the circular sectional shape as seen in FIGS. 16A and 19 embodiment. The number of such adjusting rods should not be limited to four but instead any number of adjusting rods may be provided. In addition, such adjusting rods may be provided not only at one end of the dielectric material but also at both ends of the dielectric material. The bore may be formed not only midway but also throughout the length from one end to the other. Alternatively, the adjusting rods may be provided not only in the axial direction but also in the direction perpendicular to the axial direction. In addition, the above described scheme for fine adjusting the resonance frequency of a ½ wave length resonator can be equally applicable to a ¼ wave length transverse electromagnetic mode coaxial resonator.

Now a structure of an external connection of the inventive filter will be described. Although the FIGS. 1 and 9 embodiment employ coaxial connectors 41 and 42 for the purpose of external connection, alternatively these connectors are omitted and instead a central conductor of an external coaxial cable or a semirigid cable may be directly connected to impedance matching terminals 51 and 52 and an outer conductor may be directly connected to a casing 1.

Figure 20:
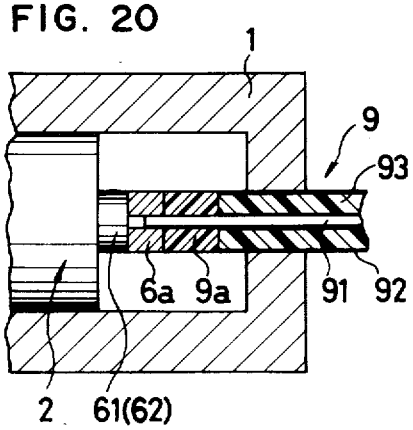
FIGS. 20 and 21 each show an enlarged sectional view of one example of an external connection for use in the present invention.
Figure 21:
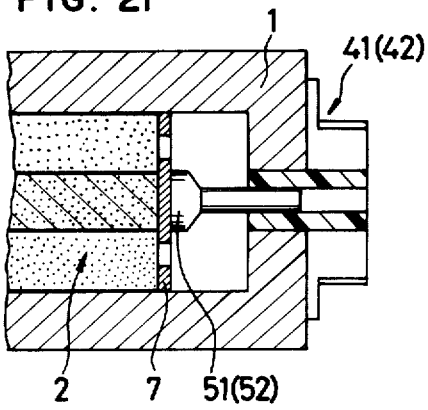

FIGS. 20 and 21 each show an enlarged sectional view of one example of an external connection for use in the present invention. With particular reference to FIG. 20, the reference numeral 9 denotes a semirigid cable, the reference numeral 91 denotes a central conductor thereof, the reference numeral 92 denotes an outer conductor thereof, and the reference numeral 93 denotes an ·ernal insulator. The central conductor 91 is pro-·uded from the external conductor 92 and the internal insulator 93 by a predetermined length. A coupling capacitor 61 (62) is provided with a metal terminal 6a and the tip end of the central conductor 91 is inserted into the central bore of the metal terminal 6*a*. The metal terminal 6*a* and the external conductor 92 and the internal insulator 93 are spaced from each other by an insulation spacer 9*a*.

With particular reference to FIG. 21, a structure for inductively coupling the resonators 2 at both ends of the inventive filter to an external circuit is shown, wherein a coupling electrode 7 is interposed between the resonator 2 and the impedance matching terminal 51 (52).

Figure 22:
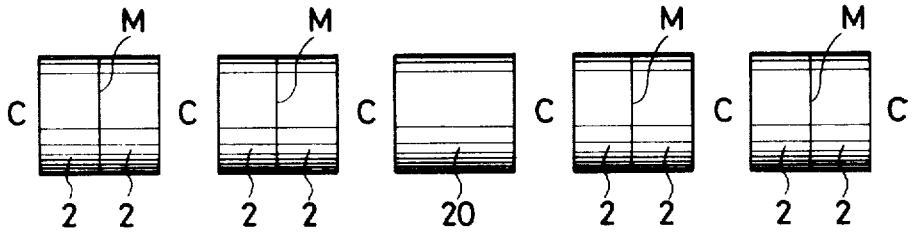
FIGS. 22 through 24 each show a modification in the combination of a ½ wave length transverse electromagnetic mode coaxial resonator and a ¼ wave length transverse electromagnetic mode coaxial resonator.
Figure 23:
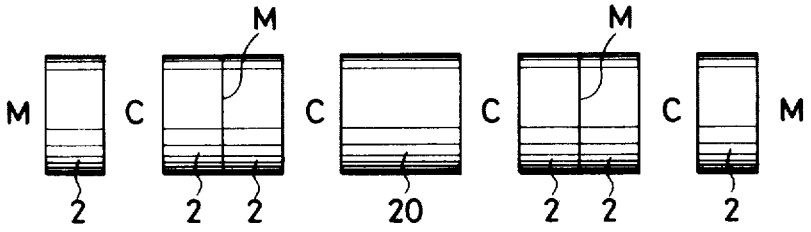
Figure 24:
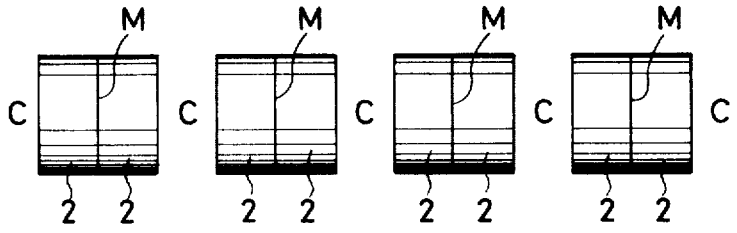

FIGS. 22 through 24 each show a modification in the combination of the various resonators of the different numbers of stages in a different coupling manner, such as a capacitive coupling and an inductive coupling. Throughout these figures, the reference character C denotes a capacitive coupling, the reference character M denotes an inductive coupling, the reference numeral 2 denotes a ¼ wave length transverse electromagnetic mode coaxial resonator, and the reference numeral 20 denotes a ½ wave length transverse electromagnetic mode coaxial resonator. As seen in these figures, the present invention enables different combinations of a ¼ wave length transverse electromagnetic mode coaxial resonator 2 and a ½ wave length transverse electromagnetic mode coaxial resonator 20.

In the foregoing, various embodiments were described with the open circuit ends of the resonators 2, 20 coupled to each other through a stray capacitance by means of the spacer 8. However, if a wide band width filter is to be implemented, a coupling capacitor such as a plate capacitor so far employed may be utilized. Conversely, if a narrow band width filter is to be implemented, a cylindrical body made of a low dielectric constant material such as quartz, forsterite, or the like may be inserted or threaded into inside the inner conductor 21 of the resonator 2, whereupon the said cylindrical body may be adhered to the respective resonators by means of an electrically conductive bonding agent. With such a structure, a coupling capacitance between the adjacent resonators becomes smaller as compared with a case of a capacitor coupling structure having a dielectric material plate sandwiched by the adjacent resonators 2.

As a result of experimentation, it has been observed that the quality factor Q of the resonator becomes maximum when the ratio of the internal diameter of the outer conductor of the resonator to the external diameter of the inner conductor of the resonator is selected to be approximately 3.6. In addition, if the temperature coefficient of the dielectric material 23 is selected to be approximate to that of the conductor material, any influence of the linear expansion coefficient of the metal conductor for the inner conductor 21 and the external conductor 22 can be eliminated, with the result that the inventive filter of the improved temperature characteristic is provided.

In fabricating the inventive filter, if the casing 1 is split into two in the axial direction and after the internal components of the resonators are fixed onto one side half case, the other half case is put on the said one half case, then there is no fear that an electrically conductive bonding agent for fixing the resonators to the half case overflows to an undesired portion.

In the foregoing, the present invention was described as comprising an arrangement of a plurality of resonators in a line within a cylindrical case. It is pointed out, however, that such a series connection of resonators may be arranged in a plurality of rows, if necessary, by connecting such plurality of rows in a zigzag fashion and thus in an electrical series fashion. In the following, therefore, further embodiments of the present invention will be described, wherein such plurality of rows of the inventive resonators are arranged in parallel rather than in a line but connected in an electrical series fashion.

Figure 25:
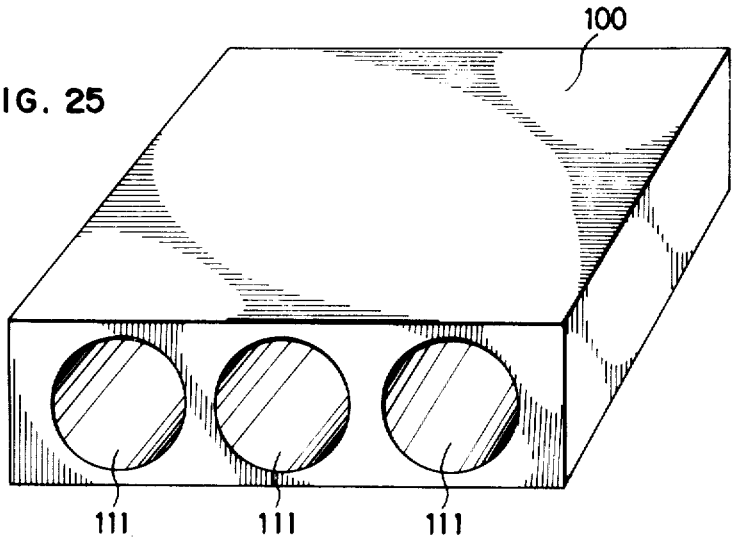
FIG. 25 shows a perspective view of a casing for use in another embodiment of the present invention.
Figure 26:
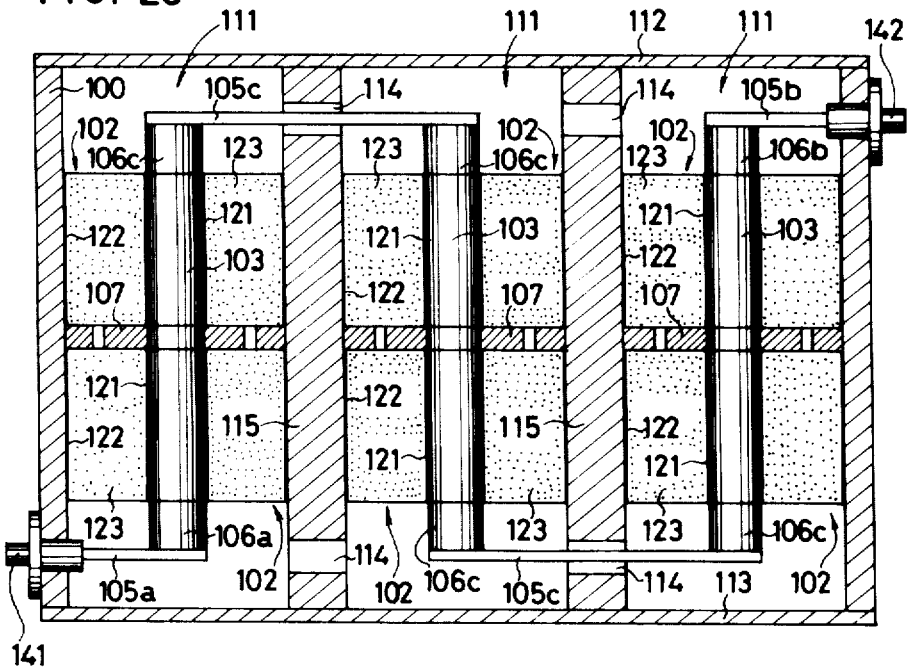
FIG. 26 shows a sectional view of a further embodiment of the present invention.

FIG. 25 shows a perspective view of a casing for use in such an embodiment of the present invention, wherein a plurality of resonators are arranged in parallel rows but in an electrical series fashion. FIG. 26 shows a plan view of the FIG. 25 embodiment, with a cover removed. FIG. 27 shows an elevational view of the FIG. 25 embodiment. A casing 100 comprises a rectangular parallelepiped made of an electric conductor material such as duralmin, wherein a plurality of bores or apertures 111 are formed in parallel, and in three parallel rows in the embodiment shown. The bores are adapted such that each is long enough to receive two ¼ wave length transverse electromagnetic mode coaxial resonators 102 in a line. After two resonators 102 are inserted and housed in each bore 111 in a line the front end surface and rear end surface of the casing 100 is sealed with a front lid 113 and a rear lid 112. Each of the ¼ wave length transverse electromagnetic mode coaxial resonators 102 may be of the same type as described in conjunction with FIG. 2. The ¼ wave length transverse electromagnetic mode coaxial resonator 102 in the first stage of the first row is coupled to an input coupling capacitor 108 and the ¼ wave length transverse electromagnetic mode coaxial resoantor 102 in the sixth stage, i.e. the second stage in the third row is coupled to an output coupling capacitor 108*b*. These coupling capacitors 108*a* and 108*b* may each comprise electrodes at the opposite end surfaces of a cylindrical dielectric material, for example, one electrode of which is connected to the inner conductor 121 of the resonator 105 and the other electrode which is connected through a lead wire 105*a* to an input coaxial connector 141 at the input side and through a lead wire 105*b* to an output coaxial connector 142 at the output side. Since the resonators 102 are each a ¼ wave length resonator, one end of the resonator is a short circuit end and the other end is an open circuit end. The open circuit ends of these resonators 102 are capacitively coupled to each other through a capacitance, while the short circuit ends of the resonators are inductively coupled by means of a coupling electrode 107. More specifically, the first stage resonator and the second stage resonator are coupled by means of a coupling electrode 107, the second stage resonator and the third stage resonator are coupled by means of a capacitance, the third stage resonator and the fourth stage resonator are coupled by means of a coupling electrode 107, the fourth stage resonator and the fifth stage resonator are coupled by means of a capacitance, and the fifth stage resonator and the sixth stage resonator are coupled by means of a coupling electrode 107. The inner conductor 121 of the second stage resonator and the inner conductor 121 of the third stage resonator are coupled through a coupling capacitor 106*c*, a lead wire 105*c* and a coupling capacitor 106*c*. The lead wire 105*c* is connected to the two coupling capacitors 106*c* through an aperture 114 formed on a partition between two adjacent bores 111. Similarly, the inner conductor 121 of the fourth stage resonator and the inner conductor 121 of the fifth stage resonator are coupled by means of a coupling capacitor 106*c*, a lead wire 105*c* and a coupling capacitor 106*c*.

In implementing the above described filter of parallel row arranged resonators, it would be possible to make various modifications without being limited to the above dipicted embodiment. More specifically, the numbers of bores 111 for parallel row arrangement of resonators should not be limited to three. Similarly, the number of two resonators to be housed in each bore should not be construed by way of limitation. The external connection such as the input coaxial connector, the output coaxial connector and the like also should not be construed by way of limitation, inasmuch as the same may be designed depending on the geometry of the required casing and the like. Although in the above described embodiment the adjacent resonators are coupled through the capacitor 106*c* at the open circuit ends, the same may be coupled through a stray capacitance.

FIG. 28 shows a sectional view of another embodiment of the external connection for use in the present invention, which has been designed to exhibit an abrupt attenuating characteristic at both sides of the required band width characteristic, as shown in FIG. 29. The internal components of the resonators 102 or 2 are arranged in a U letter shaped manner and the input coaxial connector 141 (or 41), and the output coaxial connector 142 (or 42) are provided on the same side surface of the casing 100 (or 1). If and when an aperture 115*a* is formed on a partition 115 partitioning the first stage resonator and the final stage resonator is formed, then an abrupt attenuating characteristic is attained at both sides of the band width characteristic, as seen in FIG. 29.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrical filter, comprising:

at least one ¼ wave length transverse electromagnetic mode coaxial resonator, said resonator including an inner conductor, an outer conductor surrounding said inner conductor and a dielectric member disposed between said inner conductor and said outer conductor;

an electrically conductive casing means surrounding said resonator for housing said at least one ¼ wave length transverse electromagnetic mode coaxial resonator;

input means provided through said casing and coupled to said at least one ¼ wave length transverse electromagnetic mode coaxial resonator for providing an input terminal to the ¼ wave length resonator; and output means provided through said casing and coupled to said at least one ¼ wave length transverse electromagnetic mode coaxial resonator for providing an output terminal for the ¼ wave length resonator;

wherein the coupling of said input means and said output means to the ¼ wave length resonator includes, capacitive coupling means for providing a capacitive coupling to one end of said ¼ wave length transverse electromagnetic mode coaxial resonator; and inductive coupling means for providing an inductive coupling to the other end of said ¼ wave length transverse electromagnetic mode coaxial resonator.

2. An electrical filter in accordance with claim 1, wherein the effective dielectric constant of said dielectric member at one portion of said member is smaller than the effective dielectric constant of said dielectric member at another portion of said member along the axial direction of said dielectric member.

3. An electrical filter in accordance with claim 2, wherein said one portion of said dielectric member having the smaller effective dielectric constant is a short circuit end side of said dielectric member, said short circuit end side being disposed adjacent to said inductive coupling means.

4. An electrical filter in accordance with claim 3, wherein the effective dielectric constant of said one portion of said dielectric member at the short circuit end side of said resonator is so selected to avoid any effect on the resonance frequency of the fundamental electromagnetic wave passing through said filter.

5. An electrical filter in accordance with claim 2, wherein the effective dielectric constant of said one portion of said dielectric member is made smaller than the effective dielectric constant at said another portion by using a dielectric material at said one portion having a different dielectric constant than the dielectric constant of said dielectric material at said another portion.

6. An electrical filter in accordance with claim 2, wherein the effective dielectric constant of said one portion is made smaller than the effective dielectric constant at said another portion by removing at least a portion of said dielectric member at said one portion.

7. An electrical filter in accordance with claim 1, further comprising: a plurality of said ¼ wave length transverse electromagnetic mode coaxial resonators coupled in electrical series fashion, said capacitive coupling means being disposed at one end of each of said plurality of resonators, said inductive coupling means being disposed at the other end of said each of said plurality of resonators, each of said ¼ wave length transverse electromagnetic mode coaxial resonators having aperture means formed in said dielectric member; and a dielectric bar member inserted into said aperture means, the resonance frequency of each of said resonators being adjustable in accordance with the amount of insertion of said dielectric bar member into said aperture means.

8. An electrical filter in accordance with claim 7, wherein the longitudinal axis of said aperture means is disposed along the longitudinal axis of each of said plurality of resonators.

9. An electrical filter in accordance with claim 7, wherein the dielectric constant of said dielectric member associated with each of said plurality of resonators is selected to be substantially the same as the dielectric constant of each of said dielectric bar members.

10. An electrical filter in accordance with claim 7, wherein the dielectric constant of said dielectric member associated with each of said plurality of resonators is selected to be different from the dielectric constant of each of said dielectric bar members.

11. An electrical filter in accordance with claim 7, wherein said aperture means comprises a plurality of apertures.

12. An electrical filter in accordance with claim 11, wherein a plurality of different kinds of dielectric bar members are inserted into corresponding ones of said plurality of apertures.

13. An electrical filter in accordance with claim 1, wherein said capacitive coupling means comprises a capacitor means disposed at said one end of said ¼ wave length transverse electromagnetic mode coaxial resonator.

14. An electrical filter in accordance with claim 1, wherein said capacitive coupling means comprises a stray capacitance disposed at said one end of said ¼ wave length transverse electromagnetic mode coaxial resonator.

15. An electrical filter in accordance with claim 14, wherein said stray capacitance further comprises a spacer means for adjusting the spacing between adjacent ones of said coaxial resonators.

16. An electrical filter in accordance with claim 15, wherein said spacer means comprises a dielectric material.

17. An electrical filter in accordance with claim 15, wherein said spacer means comprises a metal member.

18. An electrical filter in accordance with claim 1, wherein said inductive coupling means comprises an electrode means having coupling window means interposed between adjacent ones of said coaxial resonators.

19. An electrical filter in accordance with claim 18, wherein said electrode means comprises a plurality of coupling window means arranged symmetrically around the circumference of said electrode means.

20. An electrical filter in accordance with claim 19, wherein each of said plurality of coupling window means are fan shaped and are arranged in a radial fashion with respect to the center of said electrode means.

21. An electrical filter in accordance with claim 1, wherein said casing means comprises a cylindrical bore formed through the center of said electrical filter.

22. An electrical filter in accordance with claim 1, wherein said casing means comprises a plurality of approximately parallel cylindrical bores arranged in row-like fashion.

23. An electrical filter in accordance with claim 1, further comprising at least one ½ wave length transverse electromagnetic mode coaxial resonator coupled in electrical series fashion to said at least one ¼ wave length transverse electromagnetic mode coaxial resonator, the ½ wave length resonator including a cylindrical dielectric member having a coaxial bore therein, an outer conductor disposed on the outer periphery of said cylindrical dielectric member and electrically connected to said casing means, and an inner conductor member disposed on the inner periphery of said cylindrical dielectric member.

24. An electrical filter in accordance with claim 23, wherein the ¼ wave length resonator is inductively coupled to the ½ wave length resonator.

25. An electrical filter in accordance with claim 23, wherein the ¼ wave length resonator is capacitively coupled to the ½ wave length resonator.

26. An electrical filter in accordance with claim 7, wherein the plurality of said ¼ wave length resonators are alternately inductively and capacitively coupled to one another, beginning with the coupling between the first of said plurality of said ¼ wave length resonators and said input means and ending with the coupling between the last of said plurality of ¼ wave length resonators and said output means.

* * * * *